US006725845B2

(12) United States Patent
Holtzman

(10) Patent No.: US 6,725,845 B2
(45) Date of Patent: Apr. 27, 2004

(54) FUEL INJECTION PUMP WITH OPPOSED REGULATING SPRINGS

(76) Inventor: Barry L Holtzman, 3907 Evergreen Rd., Eagle River, WI (US) 54521

( * ) Notice: Subject to any disclaimer, the term of this patent is extended or adjusted under 35 U.S.C. 154(b) by 53 days.

(21) Appl. No.: 10/205,830

(22) Filed: Jul. 26, 2002

(65) Prior Publication Data

US 2004/0016422 A1 Jan. 29, 2004

(51) Int. Cl.[7] ..... F02M 37/04
(52) U.S. Cl. ..... 123/507; 123/435
(58) Field of Search ..... 123/435, 467, 123/470, 471, 294, 495, 507, 508; 239/584, 572, 88, 91, 92; 417/375, 379, 380

(56) References Cited

U.S. PATENT DOCUMENTS

| | | | | |
|---|---|---|---|---|
| 1,376,277 A | * | 4/1921 | Higgins Jr. | 123/250 |
| 3,425,403 A | | 2/1969 | May | 123/139 |
| 3,805,758 A | | 4/1974 | May | 123/139 |
| 4,048,970 A | | 9/1977 | Fitzgerald | 123/139 |
| 4,098,560 A | | 7/1978 | O'Neill | 417/214 |
| 4,141,675 A | | 2/1979 | O'Neill | 417/214 |
| 5,494,015 A | | 2/1996 | Rynhart | 123/294 |
| 5,685,272 A | * | 11/1997 | Paul et al. | 123/446 |
| 5,806,474 A | * | 9/1998 | Paul et al. | 123/90.12 |

OTHER PUBLICATIONS

U.S. patent application Ser. No. 09/550,774 Holtzman, filed Apr. 17, 2000.

* cited by examiner

*Primary Examiner*—Mahmoud Gimie

(57) ABSTRACT

Accordingly, the reader will see that this invention is a fuel injection pump which uses an opposed pair of springs acting in parallel to affect the movement of a piston used to pump fuel. Engine pressure pulses, preferably from an engine cylinder, apply a force on the piston and the springs affect the piston's movement to affect the quantity of fuel injected. The spring rates of the springs and their pre-load, or compression, can be adjusted to affect the fuel injection quantity. Proper selection of these spring rates and compressions allows the user to change the pump's specific output and shape this output as a function of engine torque.

20 Claims, 1 Drawing Sheet

FUEL INJECTION PUMP WITH OPPOSED REGULATING SPRINGS

BACKGROUND

1. Field of Invention

Figure 1:
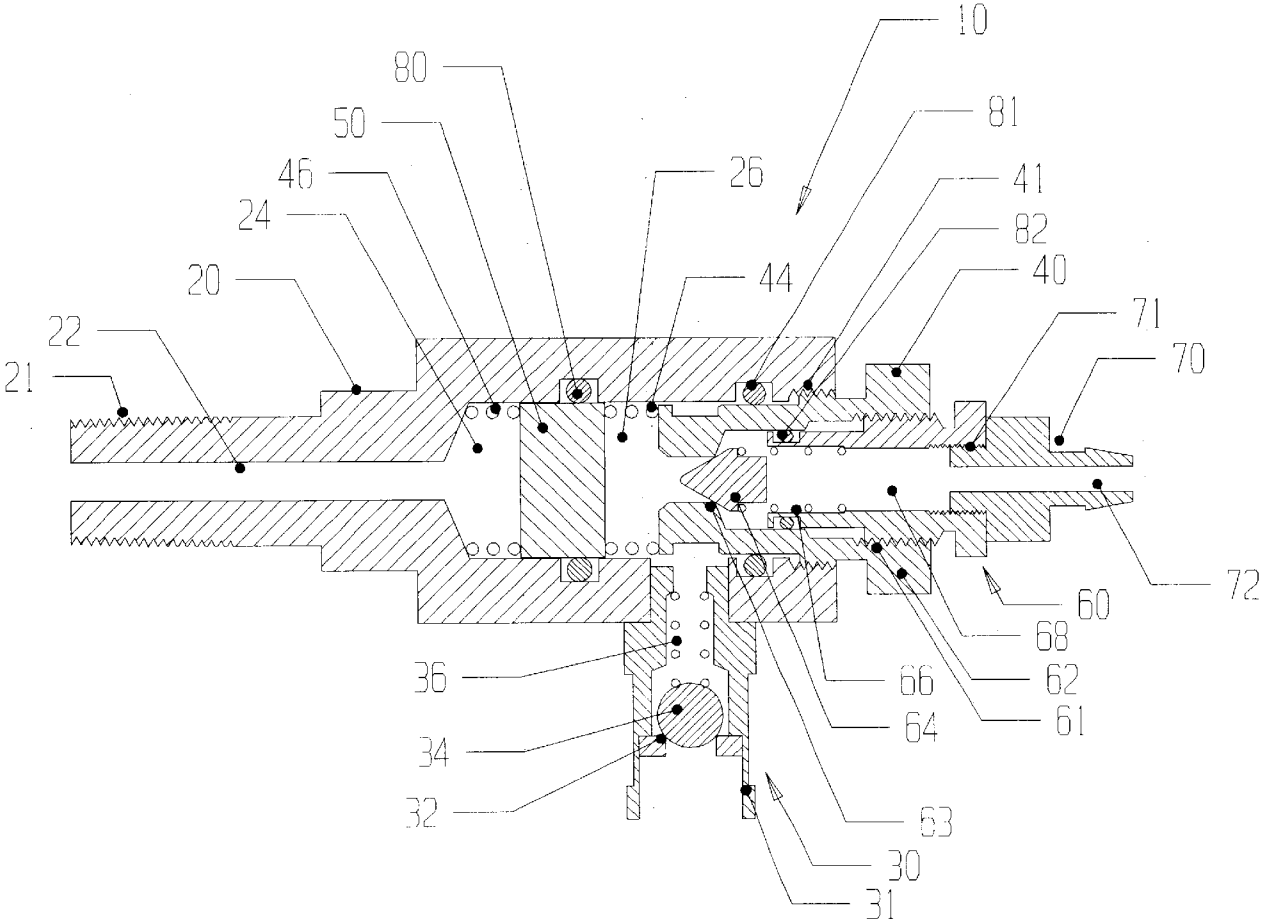

This invention is a pump for delivering fuel to an internal combustion engine in which engine pressure, preferably cylinder pressure, acts on and moves a piston whose displacement is affected by two opposed regulating springs. These regulating springs affect the pump's specific fuel output, its fuel output divided by the engine cylinder's peak pressure, for various engine torque levels. The spring rate and pre-load of these springs provide tuning adjustments to the pump. The use of these springs allows construction of a totally mechanical fuel injection pump requiring no electrical components in its operation.

BACKGROUND

2. Description of Prior Art

Various mechanical or partially mechanical fuel injection systems have been developed, and engine cylinder or crankcase pressure has been used to control various functions of these systems. Totally mechanical systems, though desirable from the standpoint of simplicity, have not gained wide usage due to a difficulty in precisely shaping fuel flow as a function of engine load. Electrical systems or hybrid electrical/mechanical systems have been developed to overcome this problem.

U.S. patents to O'Neill, U.S. Pat. No. 4,098,560 (1978) and U.S. Pat. No. 4,141,675 (1979), describe a fuel pump driven by cylinder pressure. The fuel metering is performed by an electronic "interface control unit", and the pump, driven by cylinder pressure, is designed to provide a constant fuel pressure at the injection nozzles. The pump has two pistons acted on by a "single spring", and a "limit is placed on the piston's upward stroke" (U.S. Pat. No. 4,141,675). This causes the fuel pressure from the pump to equal the pressure exerted on the fuel by the spring when the piston has reached its stop. This constant pressure is the main concern of the pump of these patents, as stated in U.S. Pat. No. 4,141,675; "Also, since engine combustion pressures vary with operating conditions and deterioration is practically unavoidable it is important that the gas-driven pump be designed so that the fuel pressure does not change". This pump is therefore not used to regulate the flow of fuel to the engine, the regulation again being performed electronically.

U.S. Pat. No. 5,494,015 to Rynhart (1996) discloses a fuel injector assembly which uses cylinder pressure to operate a "snap action" piston which times the fuel (and air) injection event. Cylinder pressure is applied to a small diameter of the piston which becomes initially slightly unseated exposing a larger area of the piston to cylinder pressure. This causes the piston to "snap" open, allowing the fuel injection event to occur. There is a limiting shoulder, however, on the piston body which limits the piston movement and seals the fuel injector from combustion gases. The piston always has a fixed displacement, moving between two limit positions. The amount of fuel injected is not determined by the piston's movement but is determined by changing the relative orientation of two spill ports, thus changing the effective stroke of the fuel injector plunger. In U.S. Pat. No. 4,048,970 to Fitzgerald (1977), a shuttle valve is operated by cylinder pressure between two limit positions, thus timing the injection event. Oil under pressure is used to provide the force for the fuel injection process, the pressure of this oil being regulated by a spool valve. This spool valve is positioned by a mechanical actuating rod, and the position of this actuating rod therefore determines the amount of fuel injected. In both of these patents, cylinder pressure is used to time the fuel injection event but does not regulate the quantity of fuel injected. U.S. patents to May, U.S. Pat. No. 3,425,403 (1969) and U.S. Pat. No. 3,805,758 (1974), describe a totally mechanical fuel injection pump which is designed to be a pumping and fuel regulating means. This pump is driven by crankcase or cylinder pressure applied to a resilient membrane, and the pumping action is obtained by the action of suitable inlet and outlet valves, known in the art. The membrane is in effect a single spring, and this single spring affects fuel delivery at all engine loads.

Applicant's co-pending application Ser. No. 09/550,774 describes a fuel injection pumps which have a moveable partition between an engine pressure chamber and a fuel chamber. This moveable partition is shown as a combination of a diaphragm and a piston and its movement is affected by the "spring" of an o-ring and the "spring" contained in the flexibility of the diaphragm. Both of these "springs" affect the movement of the diaphragm and piston at all engine torque levels.

OBJECTS AND ADVANTAGES

It is an object of this invention to provide a fuel injection pump driven by engine pressure, preferably from the engine cylinder, acting on a piston the movement of which is affected by two opposed springs. These opposed springs are pre-loaded, or compressed, such that both springs affect piston movement at small piston displacements, but only one spring affects piston movement at greater piston displacements. The spring rates of these two springs can be selected and their pre-load adjusted to affect the specific fuel output of the pumps at different engine torque levels. This allows the construction of a totally mechanical fuel injection system, requiring no electrical components.

Still further objects and advantages will become apparent from a consideration of the ensuing description and drawings.

DRAWING FIGURES

FIG. 1 shows a cross-sectional view of an embodiment of a fuel injection pump of this invention, taken in a plane containing the axis of the pump.

REFERENCE NUMERALS IN DRAWINGS

10 fuel injection pump assembly
20 pump body
21 cylinder threads
22 cylinder pressure inlet
24 cylinder pressure chamber
26 fuel chamber
30 inlet valve assembly
31 inlet valve body
32 inlet valve seat
34 inlet valve sealing ball
36 inlet valve spring
40 regulating spring pre-load adjuster
41 adjuster threads
44 high torque regulating spring
46 low-torque regulating spring
50 piston
60 outlet valve assembly
61 outlet valve threads

62 outlet valve body
63 outlet valve seat
64 outlet valve sealing tip
66 outlet valve spring
68 outlet valve conduit
70 jet
71 jet threads
72 jet orifice
80 piston o-ring
81 spring pre-load adjuster o-ring
82 outlet valve o-ring

DESCRIPTION AND OPERATION—FIG. 1

FIG. 1 shows an embodiment of a fuel injection pump assembly 10 of this invention. Assembly 10 has a body 20, made preferably from stainless steel, which is normally attached to an engine cylinder (not shown) using threads 21. Cylinder gases enter and pressurize a cylinder pressure chamber 24 through an inlet 22. Fuel enters a fuel chamber 26 through an inlet valve assembly 30 containing a body 31 with a seat 32; sealing ball 34 is urged toward seat 32 by inlet valve spring 36. A regulating spring pre-load adjuster 40 is held and positioned in body 20 by adjuster threads 41. Adjuster 40 compresses, or pre-loads, two opposed regulating springs acting in parallel; a high torque regulating spring 44 and a low torque regulating spring 46. These springs are on opposite sides of a piston 50 which is a moveable partition between chambers 24 and 26. Setting adjuster 40 positions piston 50 to its neutral position, its position when chamber 24 is not pressurized. A regulated quantity of fuel leaves chamber 26 through an outlet valve assembly 60 containing a body 62 positioned in adjuster 40 using threads 61. Outlet valve body 62 contains a seat 63 with a sealing tip 64 urged toward seat 63 by an outlet valve spring 66. Fuel passing through seat 63 enters an outlet valve conduit 68 and proceeds through a jet 70 for delivery to the engine. Jet 70 is attached to outlet valve body 62 using threads 71; jet 70 is therefore removable which allows easy selection of jet orifice 70 size. O-rings 80, 81, and 82 seal/isolate the various chambers in pump assembly 10.

For a two-stroke cycle engine, body 20 is mounted to the engine cylinder to position cylinder pressure inlet 22 preferably higher than the top of the engine's exhaust port, typically 50–70 degrees below engine piston top-dead-center. Cylinder pressure chamber 24 is therefore pressurized before the beginning of the cylinder's blowdown through the exhaust giving the most accurate pressure signal for the fuel delivery event. This pressurization of chamber 24 applies a force to piston 50 moving it toward fuel chamber 26. The force on piston 50 results in an increase in fuel pressure in chamber 26 which tends to close inlet valve 30 and open outlet valve 60, causing a pumping action. This pumping action forces fuel out through jet orifice 72 for delivery to the engine.

The forces on piston 50 of course cause its movement and consequently determine the quantity of fuel delivered by pump 10 upon application of any cylinder pressure in cylinder pressure chamber 24. The effect of o-ring 80 on piston 50 movement is negligible. The only significant forces existing on piston 50 are the opposed forces exerted by springs 44 and 46 and the forces caused by the cylinder gas pressure in chamber 24 and the fuel pressure in fuel chamber 26. It has been found that the combination of opposed, pre-loaded springs 44 and 46, affecting piston 50 movement is especially beneficial in shaping the fuel output of assembly 10 as a function of engine cylinder pressure (which determines engine torque).

To understand why this particular combination of pre-loaded springs 44 and 46 is beneficial in this application it is necessary to understand how these springs restrain the movement of piston 50 as a function of the displacement of piston 50. When a cylinder pressure pulse pressurizes chamber 24, piston 50 moves from its neutral position toward fuel chamber 26. When the displacement of piston 50 is less than the initial compression in low torque spring 46, springs 44 and 46 are acting in "parallel", and the spring rate affecting piston movement is the sum of the individual spring rates of spring 44 and spring 46. But when the displacement of piston 50 equals the initial compression in spring 46, spring 46 no longer has an affect on piston 50 movement since it no longer applies a force to piston 50. The spring rate restraining piston 50 movement at this displacement and all larger displacements is therefore only the spring rate of spring 44 which of course is lower than the sum of the spring rates of springs 44 and 46. What results therefore is a spring rate affecting piston 50 movement which is relatively high at displacements of piston 50 which are less than the initial compression in spring 46, and a relatively lower spring rate at piston 50 displacements which are larger than the initial compression in spring 46.

For any particular pump design, at a constant engine speed (RPM), a term "specific pump output" can be defined as the fuel output of the pump divided by the peak cylinder pressure of the engine. At cylinder pressures which cause a piston 50 displacement which is greater than the initial compression in spring 46, the pump's specific output will tend to be higher than the specific output at lower cylinder pressures due to the action of springs 44 and 46 discussed above. This change in the specific output of pump 10 is helpful to meet the engine's requirement of a relatively low specific fuel consumption at part throttle with relatively low cylinder pressure (to give good fuel economy), but a higher specific fuel consumption at wide open throttle with high cylinder pressure (to give high specific power).

This increase in the specific output of pump 10 is actually relatively gradual. The specific output of pump 10 starts to increase at the engine torque which causes a piston 50 displacement equal to low torque spring 46 initial compression, and gradually increases further as engine torque increases further. The level of engine torque at which this "enrichment" occurs can be adjusted by changing the compression of low torque spring 46 which is simply accomplished by rotating regulating spring pre-load adjuster 40. A rotation of adjuster 40 which moves it toward piston 50 increases the pre-load and compression on springs 44 and 46, increasing the cylinder pressure level (engine torque level) at which the pump's specific output begins to increase.

The spring rates of springs 44 and 46 can also be selected to adjust the specific output of pump 10. At any given initial compression, raising the spring rate of high torque spring 44 will lower the specific output at all engine torque levels, but will have the greatest reduction at high engine torque levels. Raising the spring rate of low torque spring 46 will reduce the specific output at low engine torque levels, with a smaller reduction in specific output at high engine torque levels.

Pumps similar to assembly 10 have been constructed which use wave springs for springs 44 and 46. Wave springs are washers which have been deformed to make "waves" in the metal around the circumference of the washer, these waves being able to deform under force and hence allow the washer to act like a spring. The wave springs used had an individual spring rate of 8E07 dynes/cm (450 pounds/in). High torque spring 44 used two of these wave springs in series giving a spring rate for high torque spring 44 one-half the individual rate, or 4E08 dynes/cm (225 pounds/inch). Low torque spring 46 used two of the wave springs in parallel giving a spring rate for low torque spring 46 twice the individual rate, or 16E08 dynes/cm (900 pounds/inch). The total spring rate affecting piston 50 at small displacements was the sum of the spring rates of springs 44 and 46 which was 4E08 dynes/cm+16E08 dynes/cm=20E08 dynes/cm (1125 pounds/inch). At higher torque levels, the spring rate affecting initial piston 50 movement is still the sum of the spring rates of springs 44 and 46 as above. But when piston 50 movement has a displacement greater than the compression in low torque spring 46, the spring rate affecting further movement of piston 50 is only the spring rate of high torque spring 44 which is 4E08 dynes/cm (225 pounds/inch).

SUMMARY, RAMIFICATION, AND SCOPE

Accordingly, the reader will see that this invention is a fuel injection pump which uses an opposed pair of springs acting in parallel to affect the movement of a piston used to pump fuel. Engine pressure pulses, preferably from an engine cylinder, apply a force on the piston and the springs affect the piston's movement affecting the quantity of fuel injected. The spring rates of the springs and their pre-load, or compression, can be adjusted to affect the fuel injection quantity. Proper selection of these spring rates and compressions allows the user to change the pump's specific output and shape this output as a function of engine torque.

Although the description above contains many specificities, these should not be construed as limiting the scope of the invention but as merely providing illustrations of some of the presently preferred embodiments of this invention. For instance, the pump's moveable partition is shown as a piston, but it can be a diaphragm or other member which can move in response to engine pressure. Also, the regulating springs can be coil springs, wave springs, disc springs, or any other flexible member, or any combination of spring types and quantities. Thus, the scope of the invention should be determined by the appended claims and their legal equivalents, rather than by the examples given.

I claim:

1. An injection pump for delivering a metered quantity of fuel to an engine, said injection pump including:

a fuel chamber with a fuel outlet to said engine, a pressure chamber with an inlet connected to and receiving pressure from said engine, said pressure from said engine having a first pressure and a second pressure, a moveable partition between said pressure chamber and said fuel chamber, a combination of springs, said combination of springs containing a first spring and a second spring, and wherein at said first pressure from said engine said first spring and said second spring affect movement of said moveable partition, and wherein at said second pressure from said engine said first spring affects movement of said moveable partition and said second spring does not affect movement of said moveable partition.

2. The injection pump of claim 1, wherein said moveable partition is a piston.

3. The injection pump of claim 1, wherein said moveable partition is a diaphragm.

4. The injection pump of claim 1, wherein said combination of springs contains a wave spring.

5. The injection pump of claim 1, wherein said combination of springs contains a disc spring.

6. The injection pump of claim 1, wherein said combination of springs contains a coil spring.

7. The injection pump of claim 1, wherein said injection pump contains a member which is effective in placing a force on said combination of springs to put a first compression in said first spring and a second compression in said second spring.

8. The injection pump of claim 7, wherein said member can be adjusted to change said first compression in said first spring and said second compression in said second spring.

9. The injection pump of claim 7, wherein said injection pump has a first specific output at a first displacement of said moveable partition which is less than said second compression in said second spring and a higher second specific output at a displacement of said moveable partition which is greater than said second compression in said second spring.

10. The injection pump of claim 1, wherein said first spring is on a first side of said moveable partition and said second spring is on a second side of said moveable partition.

11. The injection pump of claim 10, wherein said first spring and said second spring place opposing forces on said moveable partition.

12. The injection pump of claim 11, wherein said first spring and said second spring act in parallel.

13. The injection pump of claim 7, wherein, at a displacement of said moveable partition less than said second compression in said second spring, said combination of springs affects movement of said moveable partition at a spring rate which is the sum of the spring rates of said first spring and said second spring, and, at a displacement of said moveable partition greater than said second compression in said second spring, said combination of springs affects movement of said moveable partition at a spring rate which is the spring rate of said first spring.

14. The injection pump of claim 1, wherein said pressure chamber receives pressure from a cylinder of said engine.

15. An injection pump for delivering a metered quantity of fuel to an engine, said injection pump including:

a fuel chamber with a fuel outlet to said engine, a pressure chamber with an inlet connected to and receiving pressure from said engine, a moveable partition between said pressure chamber and said fuel chamber, said moveable partition having a first displacement and a second larger displacement, a first spring rate affecting movement of said moveable partition at said first displacement, a second spring rate affecting movement of said moveable partition at said second larger displacement, and wherein said first spring rate and said second spring rate are operationally different.

16. The injection pump of claim 15, wherein said first spring rate is operationally larger than said second spring rate.

17. The injection pump of claim 15, wherein said pressure chamber receives pressure from a cylinder of said engine.

18. The injection pump of claim 15, wherein said moveable partition is a piston.

19. The injection pump of claim 15, wherein said moveable partition is a diaphragm.

20. The injection pump of claim 15, wherein said pump has a first specific output at said first displacement and a second specific output at said second displacement, and said first specific output is smaller than said second specific output.

* * * * *